United States Patent [19]

Thomas et al.

[11] 4,401,428

[45] Aug. 30, 1983

[54] ZIGZAG FOLDING APPARATUS HAVING MEANS FOR DECREASING INERTIAL FORCES DURING RECIPROCATION

[75] Inventors: Hermann Thomas, Darmstadt; Hans Jakob, Darmstadt-Eberstadt, both of Fed. Rep. of Germany

[73] Assignee: Maschinenfabrik Goebel GmbH, Darmstadt, Fed. Rep. of Germany

[21] Appl. No.: 318,130

[22] Filed: Nov. 4, 1981

[30] Foreign Application Priority Data

Nov. 4, 1980 [EP] European Pat. Off. ..... 80201044.7

[51] Int. Cl.[3] ..... B65H 45/20

[52] U.S. Cl. ..... 493/415; 493/411

[58] Field of Search ..... 493/409–415; 226/118–119

[56] References Cited

FOREIGN PATENT DOCUMENTS 988080 4/1965 United Kingdom ..... 493/415

*Primary Examiner*—A. J. Heinz

*Attorney, Agent, or Firm*—Watson, Cole, Grindle & Watson

[57] ABSTRACT

A folding apparatus for the zigzag folding of a web includes an oscillating multi-section guide channel device comprising upper and lower funnels pivotally interconnected and a pair of web drawing rolls located in the immediate vicinity of the pivot axis about which the funnels are connected. The lower and upper ends of the walls of the respective funnels lie on opposite sides of the drawing rolls, and at least one of the ends of one of such walls is spaced from the rolls in the direction of web movement for defining at least one opening in the vicinity of such pivot axis for the entry of air into at least one funnel. The proximity of the rollers to the pivot axis and the contoured light weight metal walls reduce inertia forces during oscillating movement of the device and the migration of air with the web facilitate running of the web through the device so as to increase the operating speed of the folding apparatus.

3 Claims, 5 Drawing Figures

ZIGZAG FOLDING APPARATUS HAVING MEANS FOR DECREASING INERTIAL FORCES DURING RECIPROCATION

BACKGROUND OF THE INVENTION

This invention relates generally to a zigzag folding apparatus, and more particularly to such an apparatus having means for decreasing the inertial or body forces brought about during reciprocation to thereby increase the operational speed of the apparatus.

The present apparatus is of the type including an oscillating multi-section guide channel device for delivering a web of paper or other material downwardly from a web conveyer in zigzag folds, the device including upper and lower pivotally interconnected funnels or hoppers for guiding the web therebetween, and drawing rolls for drawing the web downwardly therebetween.

Such a folding apparatus may be operatively connected to a printing machine of the type which produces forms from webs of indeterminant length. After the web, comprising one or more layers, is printed or otherwise processed by such machine it is fed to the zigzag folding apparatus so that the web can be bent along crosswise lines of perforations and disposed in a zigzag stack.

The upper and lower guide funnels of the zigzag folding apparatus serve to better guide the web back and forth so that it can be bent along the crosswise lines of perforations without tenting or bulging out caused by, for example, air turbulances. Such a multi-section guide channel device for the web markedly improves upon guidance of the web to be stacked, as compared to a singlesection guide channel device.

Since the guide funnels are oscillated, and since it is desirable for the web to be folded to move as fast as possible not only through the folding apparatus but also through the machine operatively connected upstream thereof, as for example, the printing press, inertial forces are generated on the parts of the guide channel device which reciprocate. These inertial forces assume a value which limits the running speed of the printing press and, thereby that of the web. As an example, this limitation can be such that the machine connected upstream of the folding apparatus must operate below its maximum speed, because of the folding apparatus.

Folding apparatus of the aforedescribed type having a multi-section guide channel device, are disclosed in German Pat. No. 1,070,010, and in U.S. Pat. Nos. 3,889,940 and 4,045,012. Each such apparatus includes drawing rolls arranged at the downstream end of the multi-section guide channel device for pulling the web downwardly therebetween. Such an arrangement of drawing rolls, however, produces body or inertial forces which undesirably limit the maximum operational speed of the folding apparatus.

Another zigzag folding apparatus, disclosed in German Pat. No. 1,152,301, includes at the downstream end of the guide channel device a double set of drawing rolls associated with endless belts between which the web is drawn downwardly. Such an apparatus also creates inertial forces of such magnitude so as to undesirably limit the capacity of the machine operatively connected upstream of the folding apparatus.

SUMMARY OF THE INVENTION

It is therefore an object of the present invention to provide a zigzag folding apparatus having an oscillating multi-section guide channel device in which the inertial or body forces brought about by the reciprocating movement of the guide channel device are substantially lower as compared to zigzag folding apparatus of known construction.

This general objective is achieved by positioning the drawing rolls in close proximity to the pivot axis of the pivotally interconnected guide funnels which comprise an upper and lower pair of spaced walls, and lower and upper ends of such walls of the upper and lower funnels respectively lying on opposite sides of the rolls with the end of at least one of such walls being spaced from the rolls so as to define an opening in the vicinity of the pivot axis for the entry of air into its associated funnel. The proximity of the rollers to the pivot axis and the contoured light weight metal walls reduce inertia forces during oscillating movement of the guide channel device and the migration of air with the web facilitate running of the web through the device to thereby increase the operating speed of the folding apparatus. Also, the spaced walls of the upper and lower funnels being of light weight metal sheets which are contoured serve to enhance the stability thereof.

Other objects, advantages and novel features of the invention will become more apparent from the following detailed description of the invention when taken in conjunction with the accompanying drawings.

DETAILED DESCRIPTION OF THE INVENTION

Figure 1:
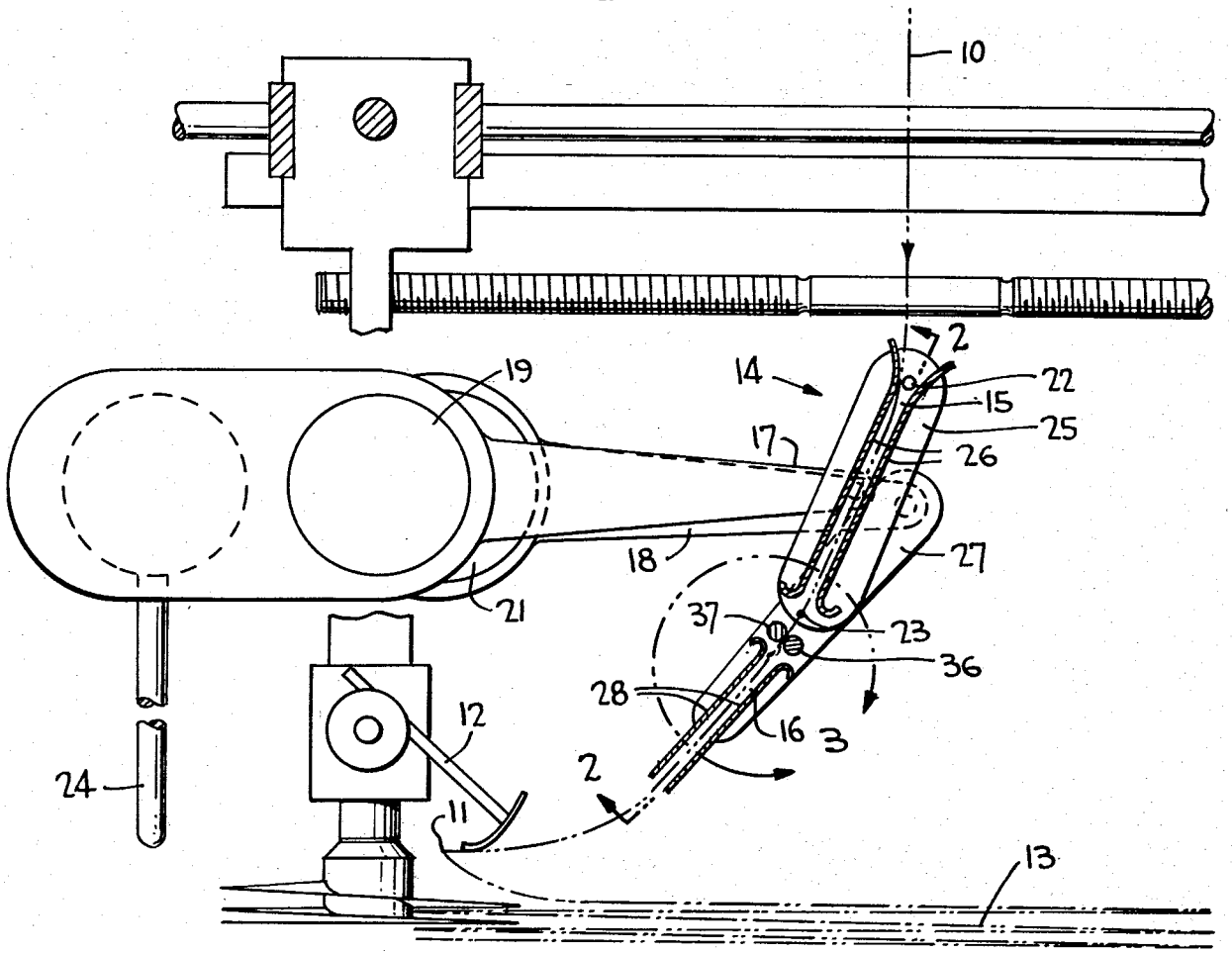
FIG. 1 is a side elevational view, partly in section, of the folding apparatus according to the invention taken substantially along the line 1—1 of FIG. 2.

In the drawings, those parts not essential to the description of the invention have not been shown in the interest of clarity, since they are known to those skilled in the art. And, like reference numerals refer to like and corresponding parts of the apparatus necessary for describing the features of the invention.

A continuous web 10 of paper or other material to be folded is shown in phantom outline in FIG. 1 and may comprise one or more superimposed layers of sheets which may be interconnected and have spaced lines of weakening disposed transversely to the direction of feed through the printer and through the folding apparatus. The web is moved downwardly from the web conveying device into the folding apparatus for folding in a manner generally similar to that described in the aforementioned patents.

The web is successively bent along one of its transverse lines 11 of weakening by means of a beater 12 to thereby form a zigzag stack 13. For this purpose, web 10 passes through a multi-section guide channel device generally designated 14 and comprising upper and lower pocket-like hoppers or funnels 15 and 16. The funnels are arranged one behind the other in the direction of web travel with the web passing therethrough as shown in the direction of the arrow. The motion of these funnels is produced by drive rods 17 and 18 which are in turn moved by respective cams 19 and 21. The tilting of funnels 15 and 16 is effected by funnel 15 being pivoted about a stationary point 22 on machine frame 20 by drive rod 17, whereas funnel 16 is pivoted about a pivot pin 23 which hingedly interconnects the upper and lower funnels together. Drive rod 18 pivots lower funnel 16 about the axis of pin 23. Cams 19 and 21 are displaceable along a horizontal slot (not shown) for adjusting the oscillating amplitude of the multi-section guide channel device for different web formats by the movement of a handle 24, all as disclosed in the aforementioned U.S. Pat. No. 3,889,940.

The upper funnel comprises a pair of spaced end plates 25 (only one of which is shown) interconnected by a pair of spaced walls 26. Similarly, the lower funnel comprises a pair of spaced end plates 27 (only one of which is shown) interconnected by a pair of spaced walls 28.

Figure 2:
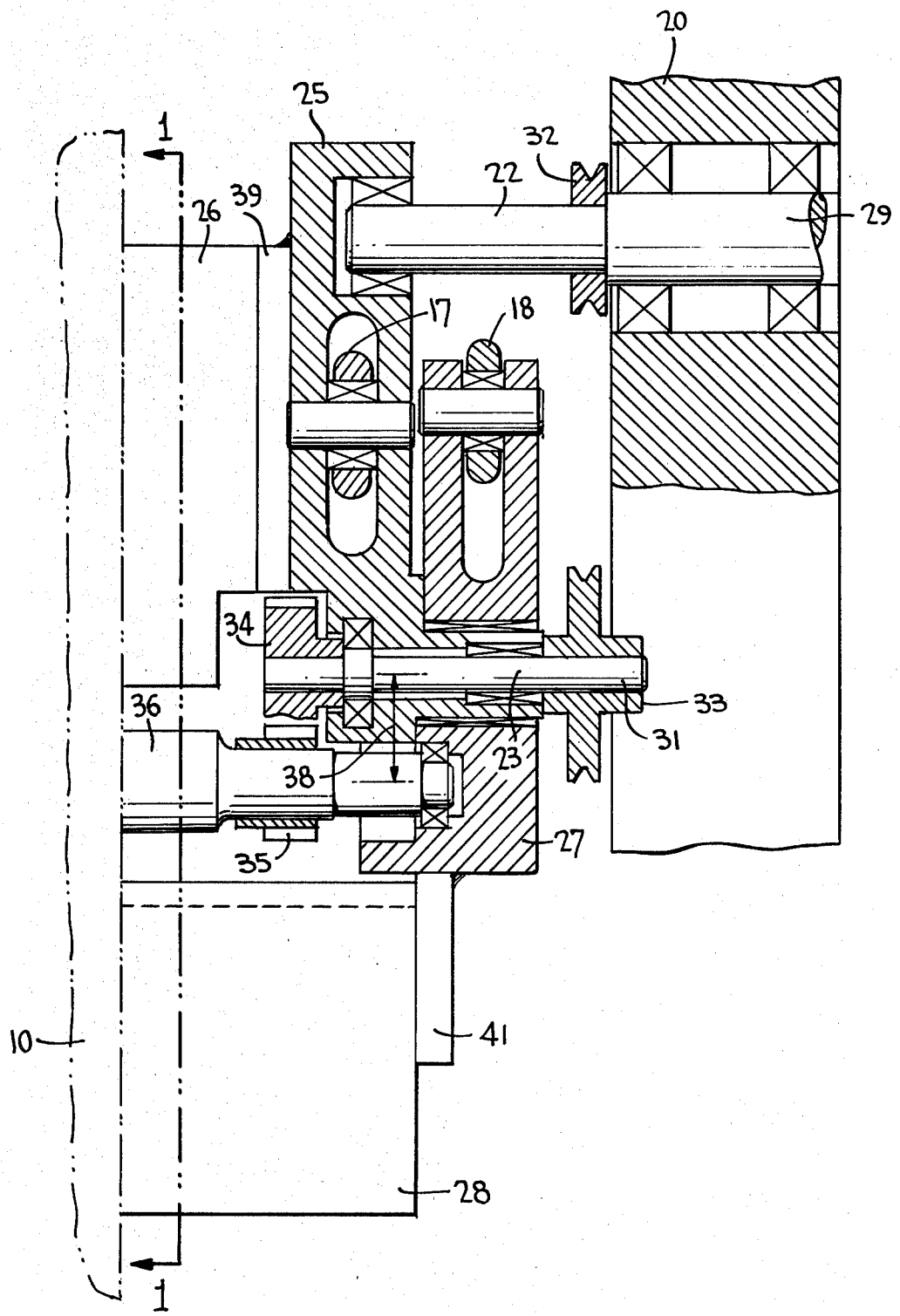
FIG. 2 is a sectional view in side elevation taken substantially along the line 2—2 of FIG. 1.

As will be seen more clearly in FIG. 2, stationary point 22 consists of a driven shaft 29 rotatably mounted in machine frame 20. Rotation of shaft 29 is transmitted to a shaft 31 extending from pivot pin 23, via belt pulleys 32 and 33 about which an endless drive belt (not shown) extends. A gear 34 on shaft 31 intermeshes with a gear 35 mounted on a drawing roller 36 which is one of a pair of cooperating drawing rollers 36 and 37 shown in FIG. 1. Gear 34 likewise intermeshes with a gear on this other drawing roller 37 but not shown in FIG. 2.

These drawing rollers extend between the end plates of lower funnel 16 in close proximity to pivot pin 23 such that a distance 38 between the central axes of the drawing rolls and the central axis of pin 23, is maintained at a minimum. Thus, the drawing gear comprising rolls 36 and 37 for the web lies in the immediate vicinity of pivot pin 23 which interconnects the upper and lower funnels. Spacing 38 can be reduced to a minimum by, for example, using ultra-high strength materials for gears 34 and 35 as well as the gear associated with roller 37.

Figure 4:
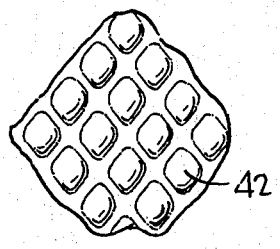
FIGS. 4 and 5 are detail views of contoured inner surfaces which may be provided for the spaced walls of the funnels.
Figure 5:
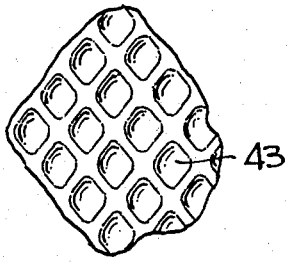

The respective end plates for the upper and lower funnels are spaced apart a distance at least to the same width as the web to be folded. And, the side walls of the upper and lower funnels may be connected to suitable support brackets 39 and 41 respectively on end plates 25 and 27. The side walls essentially comprise metal sheets of aluminum or high-grade steel so that they can be as light as possible, yet be resistant to vibrations. The inner surfaces of these side walls are at least temporarily contacted by the web passing therebetween during the reciprocating movement of the guide channel device. In order to further increase the stability of the side walls, that is, in order to make the side walls as thin and as light as possible, they may be contoured in the form of corrugations 42 or 43, as shown in FIGS. 4 and 5. However, other types of contouring different from that shown in the drawings may be adopted.

Figure 3:
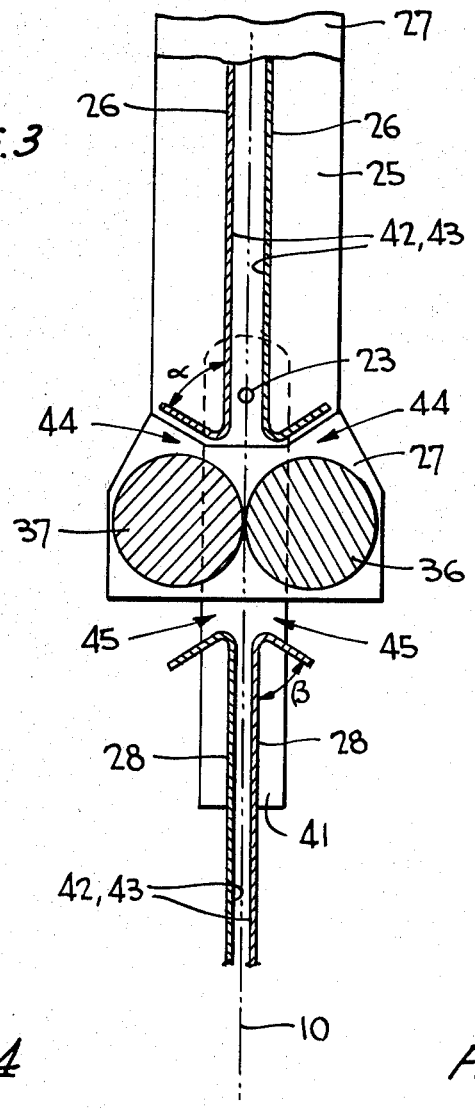
FIG. 3 is an enlarged detail view of a portion of the apparatus of FIG. 1, the upper and lower funnel guides being shown coaxial for clarity.

As shown in FIG. 3, side walls 26 of the upper funnel and side walls 28 of the lower funnel respectively lie on opposite sides of drawing rolls 36 and 37, so as to define openings 44 and 45 across the entire width of the web to be folded for the entry of air into the funnels. This air migrates with web 10 and functions, together with the drawing rolls to transport the web through the channel. The fact that the drawing rolls are in proximity to the pivot pin 23 and the further fact that the metal walls of the funnels are of little weight but nevertheless high stability increase the operating speed of the folding apparatus. The upper and lower ends of the respective upper and lower funnels may be flared outwardly to form angles $\alpha$ and $\beta$ so as to further define openings 44 and 45.

The folding apparatus according to the invention permits both heavy and thick as well as relatively light and thin webs 10 to be processed equally as well. And, it should be apparent that drive rods 17 and 18 are each one of a pair as are the support brackets for the side walls, and the pivot pins. Thus, essentially only one half the folding apparatus of the invention has been illustrated and described hereinabove.

And, from the foregoing, it can be seen that with the improved folding apparatus according to the invention it is possible to increase not only the operating speed of the apparatus, but also the operating speed of the machine connected upstream therewith, such as a printing machine. In such manner the capacity of the entire machine is considerably increased.

Obviously, many modifications and variations of the present invention are made possible in the light of the above teachings. It is therefore to be understood that within the scope of the appended claims the invention may be practiced otherwise than as specifically described.

What is claimed is:

1. In a folding apparatus including an oscillating multi-section guide channel device for delivering a web of paper or other material downwardly from a web conveyor in zigzag folds, said device comprising upper and lower funnels interconnected about a pivot axis for pivotable movement relative to one another and each including a pair of spaced walls for guiding the web therebetween, means for oscillating each said funnel independently of one another, and means on said device comprising a pair of rolls for drawing the web downwardly therebetween, the improvement wherein the walls are contoured and said pair of spaced walls of each of said funnels are of light weight metal and the confronting surfaces of each said pair of spaced walls are contoured for structural stability and to facilitate migration of air with the drawn web, said pair of rolls of said drawing means being mounted on said lower funnel, said rolls respectively being mounted for rotation on axes located between said upper and lower funnels and at a short predetermined minimum distance from the pivot axis of said interconnected funnels, lower and upper ends of said walls of said upper and lower funnels respectively lying on opposite sides of said rollers, and at least one of said ends of one of said walls being spaced from said rollers in the direction of web movement so as to define at least one opening in the vicinity of said pivot axis for the entry of air between said one wall and the wall spaced therefrom, whereby the proximity of said rollers to said pivot axis and the contoured light weight metal walls reduced inertia forces during oscillating movement of said device and the migration of air with the web facilitates drawing of the web through the device to thereby increase the operating speed of the folding apparatus.

2. In the apparatus according to claim 1, wherein said lower and upper ends of said walls are flared outwardly for defining openings for the entry of air into said funnels.

3. In the apparatus according to claim 1 or 2, wherein said walls are of aluminum or steel.

* * * * *